US010488127B2

(12) United States Patent
Jezierski et al.

(10) Patent No.: US 10,488,127 B2
(45) Date of Patent: Nov. 26, 2019

(54) COUNTERMASS PROPULSION SYSTEM

(71) Applicant: Nammo Talley, Inc., Mesa, AZ (US)

(72) Inventors: Dominic Jezierski, Chandler, AZ (US); Stephen Joseph Early, Mesa, AZ (US); Bill Goodwin, Gilbert, AZ (US); Nick Adamo, Mesa, AZ (US); David Kneble, Scottsdale, AZ (US)

(73) Assignee: NAMMO TALLEY, INC., Mesa, AZ (US)

( * ) Notice: Subject to any disclaimer, the term of this patent is extended or adjusted under 35 U.S.C. 154(b) by 0 days.

(21) Appl. No.: 15/507,495

(22) PCT Filed: Feb. 27, 2017

(86) PCT No.: PCT/US2017/019764

§ 371 (c)(1),
(2) Date: Feb. 28, 2017

(87) PCT Pub. No.: WO2017/204875

PCT Pub. Date: Nov. 30, 2017

(65) Prior Publication Data

US 2018/0363997 A1 Dec. 20, 2018

Related U.S. Application Data

(60) Provisional application No. 62/301,278, filed on Feb. 29, 2016.

(51) Int. Cl.
*F41A 1/10* (2006.01)

(52) U.S. Cl.
CPC ..... *F41A 1/10* (2013.01)

(58) Field of Classification Search
CPC ..... F41A 1/10
USPC ..... 89/1.701
See application file for complete search history.

(56) References Cited

U.S. PATENT DOCUMENTS 1,108,714 A * 8/1914 Davis ..... F41A 1/08 102/430
1,108,715 A * 8/1914 Davis ..... F41A 1/10 89/1.701
1,108,717 A * 8/1914 Davis ..... F42B 5/02 102/430

(Continued)

FOREIGN PATENT DOCUMENTS

GB 2183800 A 6/1987
WO 2017172170 A3 12/2017

OTHER PUBLICATIONS

Formate Technical Manual. Technical Manual (online), Cabot Corporation, (2013) Retrieved on Jul. 5, 2019. Retrieved from the Internet: http://www.cabotcorp.com/solutions/porducts-plus/cesium-formate-brines/formate-technical-manual.

(Continued)

*Primary Examiner* — Samir Abdosh
(74) *Attorney, Agent, or Firm* — Pepper Hamilton LLP

(57) ABSTRACT

The invention relates to a countermass propulsion system for shoulder-launched munitions, recoilless rifles, rockets and similar class weapon systems, fired from an enclosure and utilizing a Davis Gun propulsion system by accelerating a projectile in one direction and a countermass in the opposing direction to minimize recoil, light signature and acoustic signature of the weapon system.

15 Claims, 5 Drawing Sheets

(56) References Cited

U.S. PATENT DOCUMENTS

| | | | | | |
|---|---|---|---|---|---|
| 1,395,630 | A | * | 11/1921 | Davis | F41A 1/10 89/1.701 |
| 2,156,605 | A | * | 5/1939 | Prettyman | F41A 1/10 89/1.701 |
| 3,149,531 | A | * | 9/1964 | Musgrave | F41A 1/08 102/334 |
| 3,279,319 | A | * | 10/1966 | Semonian | F41A 1/10 89/1.701 |
| 3,307,451 | A | * | 3/1967 | Bucklisch | F41A 1/06 89/1.701 |
| 3,800,656 | A | | 4/1974 | Schnabele | |
| 4,132,148 | A | * | 1/1979 | Meistring | F41A 1/10 89/1.701 |
| 4,244,293 | A | | 1/1981 | Grosswendt et al. | |
| 4,484,524 | A | * | 11/1984 | Dawant | F41A 1/10 102/437 |
| 4,554,860 | A | | 11/1985 | Johansson et al. | |
| 5,337,648 | A | | 8/1994 | Brage | |
| 5,551,330 | A | | 9/1996 | Reuche | |
| 5,874,474 | A | | 2/1999 | Peterson et al. | |
| 5,952,601 | A | | 9/1999 | Sanford et al. | |
| 6,214,889 | B1 | | 4/2001 | Peterson et al. | |
| 6,543,329 | B2 | | 4/2003 | Sanford et al. | |
| 6,971,299 | B2 | | 12/2005 | Franzen et al. | |
| 7,353,739 | B2 | | 4/2008 | Ax et al. | |
| 7,624,668 | B1 | * | 12/2009 | Sanford | F41A 1/10 102/437 |
| 7,814,696 | B2 | * | 10/2010 | Rapp | F42B 5/035 102/437 |
| 7,823,497 | B2 | | 11/2010 | Ostberg et al. | |
| 8,220,376 | B2 | * | 7/2012 | Jonsson | F41F 3/0455 89/1.701 |
| 8,448,556 | B2 | | 5/2013 | Regebro | |
| 8,707,847 | B2 | | 4/2014 | Wang et al. | |
| 2002/0112601 | A1 | | 8/2002 | Sanford et al. | |
| 2004/0035580 | A1 | | 2/2004 | Bouwmeester et al. | |
| 2005/0101491 | A1 | | 5/2005 | Vollmer | |
| 2005/0107264 | A1 | | 5/2005 | van Batenburg et al. | |
| 2006/0009649 | A1 | | 1/2006 | Murray et al. | |
| 2006/0169175 | A1 | | 8/2006 | Lende | |
| 2007/0068374 | A1 | | 3/2007 | Ostberg et al. | |
| 2007/0261848 | A1 | | 11/2007 | Benton | |
| 2010/0204511 | A1 | | 8/2010 | Horton et al. | |
| 2012/0055237 | A1 | | 3/2012 | Sweeney et al. | |
| 2012/0204750 | A1 | | 8/2012 | Sullivan et al. | |
| 2014/0007758 | A1 | | 1/2014 | Wang et al. | |
| 2014/0262283 | A1 | | 9/2014 | Savari et al. | |
| 2014/0265074 | A1 | | 9/2014 | Goossens et al. | |
| 2014/0343413 | A1 | | 11/2014 | Jolck et al. | |
| 2015/0144565 | A1 | | 5/2015 | Kaminski et al. | |
| 2015/0152033 | A1 | | 6/2015 | Bakke | |
| 2016/0376488 | A1 | | 12/2016 | Galindo et al. | |

OTHER PUBLICATIONS

International Search Report for International Application No. PCT/US2017/019749, International Search Report dated Nov. 3, 2017.

International Search Report for International Application No. PCT/US2017/019764, International Search Report dated Dec. 26, 2017.

Nonfinal Office Action dated Apr. 4, 2019, U.S. Appl. No. 15/507,476.

Supplementary European Search Report for EU Application No. EP17776176 Supplementary Search Report dated Jul. 23, 2019.

Supplementary European Search Report for EU Application No. EP17803190 Supplementary Search Report dated Aug. 2, 2019.

* cited by examiner

COUNTERMASS PROPULSION SYSTEM

CROSS-REFERENCE TO RELATED APPLICATIONS

This application is the U.S. National Phase of PCT/US17/19764, filed on Feb. 27, 2017, which claims the benefit of U.S. Provisional Application No. 62/301,278, filed on Feb. 29, 2016, which are incorporated herein by reference.

FIELD OF THE INVENTION

The present invention relates to ordnance, ammunition, and explosives. More particularly, the invention relates to shoulder-launched munitions, recoilless rifles, rockets and similar class weapon systems, which utilize the Davis Gun principle for accelerating a projectile in one direction and a countermass in the opposing direction to minimize recoil, visual signature, and acoustic signature of the weapon system. The countermass propulsion system has a fire from enclosure (FFE) capability.

BACKGROUND OF THE INVENTION

There are three basic types of projectile propulsion systems: the closed breach gun, rocket motors, and recoilless rifles. A fourth type, the Davis Gun, has never been weaponized for fire from enclosure capability.

The closed breach gun system works by the combustion of a propellant charge within a combustion chamber. As the propellant charge burns, pressure increases and accelerates the projectile down a barrel (gun tube). The closed breach gun system has substantial recoil, visual signature, and acoustic signature. In this type of system, the combustion gases exit the barrel at the muzzle and only the projectile travels down range.

The majority of current shoulder-launched munitions utilize rocket motor propulsion systems. Rocket motors function by combusting propellant within a pressure vessel, which is typically attached to the warhead. The high-pressure gases generated by the propellant combustion are expelled through a throat and out a nozzle, generating thrust or forward motion of the projectile within the launcher. This type of propulsion system can be used to minimize recoil felt by the user; however, it also has substantial visual signature and acoustic signature.

Recoilless rifles are a hybrid of the closed breach gun system and the rocket motor. This type of propulsion system functions by combusting propellant within the combustion chamber and the exhaust gases travel through a throat and a nozzle. However, both the throat and the nozzle are permanently installed into the launch tube and do not travel down range with the projectile. The nozzle within the launch tube is used to balance recoil. This type of propulsion system also has substantial visual signature and acoustic signature.

U.S. Pat. No. 6,971,299 utilizes a high-pressure and low-pressure system with a countermass. The system reports utilizing constrictive gas outlets within the high-pressure section prior to the low-pressure section. However, this reference does not report any technical features to ensure that the internal ballistic pressure reaches a specific limit prior to release of the projectile and interaction of the combustion gases with the countermass.

U.S. Pat. No. 8,448,556 also utilizes a high-pressure and low-pressure system with a countermass. The countermass reportedly maintains a proportionately high gas pressure in the countermass chamber, to balance the backward recoil from the projectile. The system reports improved control of gas flows from the high-pressure part to the low-pressure part regulated by the projectile in the launch tube and minimal recoil forces due to arrangement with an internal expansion nozzle coupled to the low-pressure part. The projectile is positioned in a first start position in the launch tube, where the projectile blocks the gas-openings, and where the projectile, upon ignition of the propellant charge, moves forward in the launch tube to further positions, where the gas-openings, successively, are unblocked by the projectile.

U.S. Pat. No. 8,220,376 utilizes a system in which the forward direction recoil disengages the launching tube from the firing and supporting unit. Thus, the countermass is designed such that a forward-directed recoil is obtained, and the launching tube is designed to be disengageable from the firing and supporting unit during the forward-directed recoil. This system purportedly balances recoil by transferring kinetic energy generated during firing to the launching tube.

U.S. Pat. No. 7,353,739 utilizes a separate countermass container, which is placed within the barrel. This reference reports that air is purposely trapped within the countermass container as a means to compensate for thermal expansion and contraction effects within the countermass. This countermass utilizes viscosity-changing additives, as well as the addition of micro-balloons as a means to bind and retain the countermass fluid.

SUMMARY OF THE INVENTION

The present invention is directed to a countermass propulsion system for an FFE recoilless weapon, and a method of launching a projectile from the countermass propulsion system. The countermass propulsion system comprises a pressure vessel. The pressure vessel may house a projectile, disposed at the muzzle end of the weapon; a countermass, disposed at the breach end of the weapon; a propellant charge, disposed between the projectile and the countermass; a rupture disk, disposed at the forward end of the countermass behind an igniter assembly; and a projectile retention means that is connected to the projectile and the rupture disk. With respect to the various tests of the system described in this application, the inventors evaluated the system in accordance with MIL-STD-1474 "Design Criteria Standard Noise Limits" and ITOP-5-2-517 "Fire from Enclosure Testing," which are publically available, readily understood by those of ordinary skill in the art, and incorporated herein in their respective entireties by way of this reference. Regarding MIL-STD-1474, the inventors evaluated the performance of the tested embodiments against both revision D and revision E of that standard. The inventors used raw sound data in their tests and, as a person of ordinary skill in the art would appreciate from reading both of these revisions D and E of the MIL-STD-1474, the calculation methods of both of these revisions are applicable to the tests.

In one embodiment, the countermass propulsion system has a minimized acoustic signature. Preferably, the minimized acoustic signature is a sound pressure level (SPL) less than 175 dB as measured at a location 20 in. forward from the breach of the countermass propulsion system and 7 in. off of centerline of the weapon in two locations (average) while being fired from a 15 ft.×12 ft.×7 ft. enclosure. Preferably, the acoustic signature is a SPL of no more than 173.5 dB. More preferably, the acoustic signature is a SPL of no more than 170 dB.

In another embodiment, the countermass propulsion system has a minimized recoil energy. Preferably, the minimized recoil energy is in the range of 0-16 ft·lbs. More preferably, the minimized recoil energy is in the range of 0-5 ft·lbs. More preferably, the minimized recoil energy is in the range of 0-2 ft·lbs.

In another embodiment, during functioning of the countermass propulsion system, the rupture disk may remain closed to a predetermined point in time, so that combustion gases in the pressure vessel chamber are not exposed to the countermass. The rupture disk may rupture and open at a static pressure in a range of 300 to 2,000 psi. More preferably, the static burst pressure of the rupture disk is in a range of 1,000 to 1,500 psi. In another particular embodiment, the rupture disk may be disposed at the forward end of the countermass behind an igniter assembly. Preferably, the rupture disk composition of the countermass propulsion system may be selected from the group consisting of at least one or more of a stainless steel and an austenite nickel-chromium-based superalloy.

In another embodiment, during functioning of the countermass propulsion system, the projectile remains attached to the projectile retention means until ignition of the propellant charge occurs. Additionally, in another particular embodiment, the retention means may be connected to the projectile on a first side of the projectile retention means and may be connected to the rupture disk on a second side of the projectile retention means. Furthermore, in another particular embodiment, the projectile retention means may release the projectile at a predetermined tensile load has been reached. Preferably, the projectile retention means may release the projectile after a maximum tensile load of 1,050 to 7,000 lbf is reached, where the maximum tensile load range of the retention means is dependent upon the selected rupture disc pressure range. In another particular embodiment, the projectile retention means may be a tensile rod and threads, tensile links, pins, threads, and the like. Preferably, the projectile retention means is a breakbolt.

In another embodiment, the aft seal may control the pressure at which the countermass is released during firing of the weapon. Furthermore, in another particular embodiment, the aft seal may be configured to expand and compensate for thermal contraction and expansion of the countermass during storage at a temperature range of −60° F. to 160° F.

In another embodiment, the countermass may be a low-corrosion fluid with a high density (i.e., density greater than 1 gm/cm$^3$) and a low freezing point (i.e., fluid does not freeze at −94° F. (−70° C.)). The countermass may be located between the rupture disk and an aft seal.

In another embodiment, the propellant charge may be disposed between the projectile and the countermass. In another particular embodiment, the propellant charge compositions may include, but are not limited to, a nitrocellulose paper filled with an M9 propellant. Additionally, in another particular embodiment, the propellant charge may be a nitrocellulose paper filled with a solid propellant.

In another embodiment, the pressure vessel may be lined with compositions including, but not limited to, titanium and an epoxy resin.

In another embodiment, the countermass propulsion system is a single-use, disposable system or a reusable system.

The method of launching the countermass propulsion system comprises the following:

Initiating an ignition line that is connected to an ignition charge.

Igniting the propellant charge by the ignition charge, wherein the propellant charge is disposed inside a pressure vessel. The ignition of the propellant charge rapidly increases the pressure inside the pressure vessel. During the functioning of the countermass propulsion system, the pressure inside the pressure vessel may, for example, increase within the range of 3,000 to 20,000 psi.

Releasing the projectile by fracturing the projectile retention means after a maximum tensile load has been reached. In one particular embodiment, the maximum tensile load may be in the range of 1,050 to 7,000 lbf.

Rupturing and opening of the rupture disk at a predetermined static burst pressure in the range of 300 to 2,000 psi. The result of which results in a net forward load on the projectile and which exerts pressure on the countermass. The force exerted against the countermass pushes the countermass onto the aft seal of the pressure vessel.

Exiting of the countermass out of the breech of the weapon after the aft seal is broken.

The relative timing of projectile release using the projectile retention means and the opening of the rupture disk ensures a recoil of 0-16 ft·lbs at an operational temperature range of −60° F. to 160° F. The rupture and opening of the rupture disk and the fracture of the projectile retention means releasing the projectile is simultaneous after an increase in the static burst pressure of the rupture disk and an increase in the tensile strength of the projectile retention means.

DETAILED DESCRIPTION OF THE INVENTION

Figure 1:
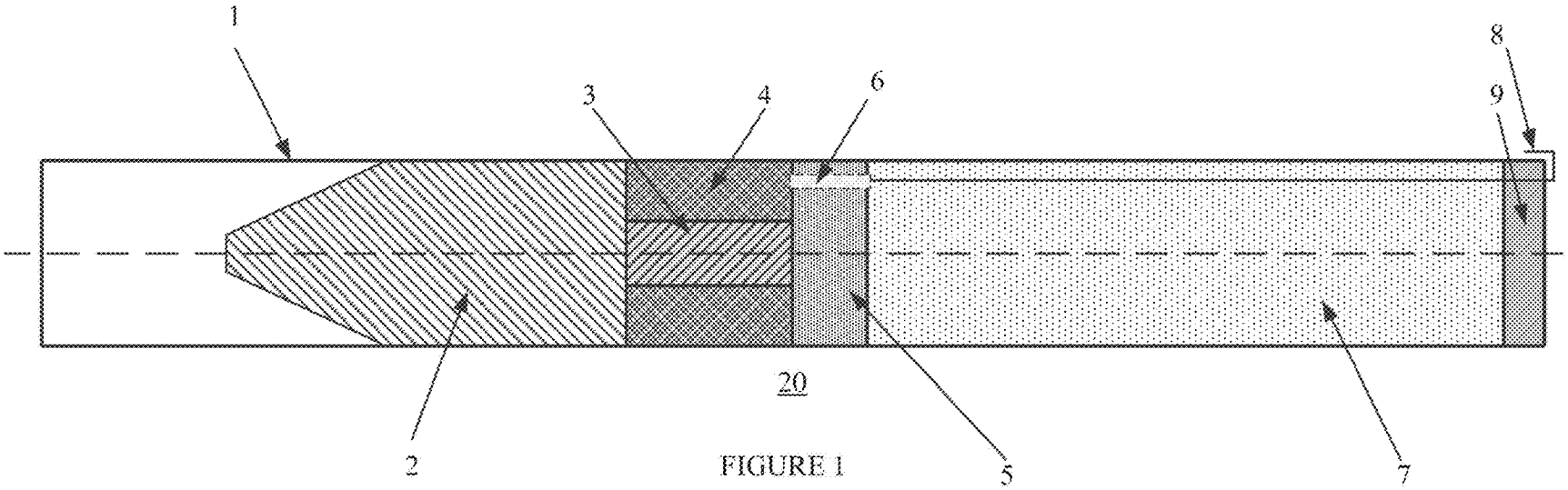
FIG. 1 illustrates a shoulder launched munition propulsion system.

The present invention utilizes a Davis Gun propulsion system, which was first conceptualized by Cleland Davis in the early 1900s in U.S. Pat. No. 1,108,715. This type of propulsion system functions by combusting propellant within the combustion chamber. The resultant pressure accelerates the projectile towards the muzzle end and the countermass towards the breach end. This type of propulsion system minimizes recoil felt by the user and minimizes visual and acoustic signatures.

As used herein, a minimized acoustic signature refers to a sound pressure level (SPL) less than 175 dB as measured at a location 20 in. forward from the breach and 7 in. off of centerline of the weapon in two locations (average) while being fired from a 15 ft.×12 ft.×7 ft. enclosure. Preferably, the acoustic signature is a SPL of no more than 173.5 dB. More preferably, the acoustic signature is a SPL of no more than 170 dB. This is for the firing condition (temperature) that results in the highest SPL and shall be an average of at least 10 firings.

$$SPL = 20\ \log_{10}\left(\frac{p}{2.90\times10^{-9)}}\right)$$

Minimized recoil is a desirable feature of a recoilless weapon. Minimizing recoil is accomplished by reducing the actual recoil energy or muzzle velocity. As used herein, the minimized recoil refers to a recoil energy of 0-16 ft·lbs in a comparable system across the operational temperature range of −60° F. to 160° F. Preferably, the recoil is in a range of 0 to 5 ft·lbs. More preferably, the recoil is in a range of 0 to 2 ft·lbs.

The detailed engineering solution depends upon the selection of the countermass, the internal ballistic solution, and the relative motion of the projectile with respect to the countermass. Thus, finding the optimal design space yields a weapon system that has a minimized recoil felt by the user across a temperature range of −60° F. to 160° F., minimal acoustic and visual signatures, and a high muzzle velocity, while maintaining a less than 10 ft./sec. standard deviation in muzzle velocity variation in a comparable propulsion system at any individual temperature in the −60° F. to 160° F. range.

The propulsion system of the present invention utilizes a pressure vessel and does not require constrictive gas outlets for combustion gases to pass through prior to interacting with the countermass. The present invention functions by ensuring that the pressure within the pressure vessel remains unchanged until proper propellant charge ignition has occurred.

The propulsion system of the present invention balances recoil by adjusting the following parameters: the strength, i.e., the tensile capacity, of the projectile retention means, the static burst pressure of the rupture disk and the countermass viscosity. The static burst pressure of the rupture disk functions together with the tensile capability of the projectile retention means to regulate the force applied to the projectile.

Preferably, the static burst pressure of the rupture disk (also referred to as burst disc) is in a range of 300 to 2,000 psi. More preferably, the static burst pressure of the rupture disk is in a range of 1,000 to 1,500 psi.

The countermass propulsion system of the present invention has a fire from enclosure capability, which allows the system to function within a small room without creating a hazard to the user across the operational temperature range. The countermass propulsion system provides substantial elimination of the back blast hazard and visual signature, as well as recoil of 0-16 ft.-lbs across the wide operational temperature range of −60° F. to 160° F. For example, substitution of a countermass for the rocket motor on the M72-FFE reduced back blast and firing noise as well as smoke and flash, with no loss in muzzle velocity.

More preferably, the back blast is such that no hazardous debris is capable of perforating with non-zero residual velocity the front sheet of ½ in. gypsum board installed in the movable wall located 10 ft. from the breach of the weapon.

The countermass propulsion system maximizes the projectile muzzle velocity and minimizes the muzzle velocity variation at a given temperature to meet the probability of hit ("Phit"). The countermass propulsion system is low cost and low weight, and can be used within a single use disposable system or within a system with a reusable launcher.

The countermass propulsion system, which utilizes the Davis Gun principle for acceleration of a projectile towards the muzzle end and a countermass towards the breach end, comprises a propellant charge, a countermass fluid, a rupture disk, projectile retention means, and a pressure vessel. These features need to function appropriately for the propulsion system to yield the desired results, which include sufficient muzzle velocity, reduced muzzle velocity variation at a given temperature 400 to 800 ft./sec., minimal recoil, minimal visual signature, and meeting the fire from enclosure acoustic requirement.

FIG. 1 illustrates countermass propulsion system 20 with countermass liquid 7. Countermass propulsion system 20 may comprise pressure vessel 1. Pressure vessel 1 may house the following: projectile 2, projectile retention means 3, solid propellant charge 4, rupture disk 5, ignition charge 6, countermass liquid 7, ignition line 8, and aft seal 9. Projectile 2 may be housed towards the muzzle end of pressure vessel 1 and aft seal 9 may be housed at the breach end of pressure vessel 1. Rupture disk 5 may be housed between projectile 2 and aft seal 9. Projectile retention means 3 may be attached to projectile 2 on one side and attached to rupture disk 5 on a second side. Additionally, solid propellant charge 4 may be disposed between projectile 2 and rupture disk 5.

Countermass liquid 7 is disposed towards the breach end of pressure vessel 1 and may be disposed between rupture disk 5 and aft seal 9. Ignition line 8 may pass through aft seal 9, through countermass liquid 7, and may attach to ignition charge 6. Ignition charge 6 may be disposed through rupture disk 5 and have one side facing countermass liquid 7 and a second side facing solid propellant charge 4.

Countermass propulsion system 20 functions when a pyrotechnic even ignites ignition line 8. Ignition line 8 transfers the pyrotechnic charge through aft seal 9 and countermass liquid 7 to ignition charge 6. Ignition charge 6 transfers the pyrotechnic charge through rupture disk to solid propellant charge 4. Alternatively, the ignition line 8 can be configured such that it does not go through the aft seal, but instead is positioned to proceed around the back of the pressure vessel 1 and between the pressure vessel 1 and the aft seal 9.

Figure 3:
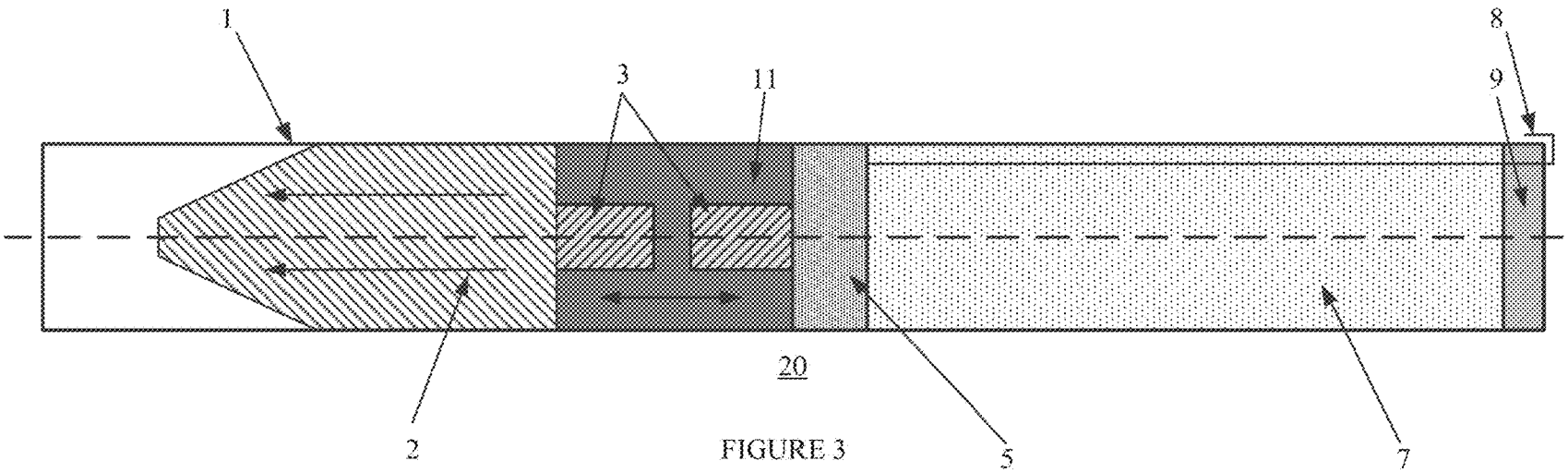
FIG. 3 illustrates a shoulder launched munition propulsion system during a second stage of operation.

FIG. 3 illustrates when the pressure inside pressure vessel 1 reaches a predetermined value and projectile retention means 3 releases projectile 2. Once projectile retention means 3 releases projectile 2, propellant gas 11 exerts a force against projectile 2 which causes projectile 2 to move towards the muzzle end of pressure vessel 1. Preferably, retention means releases projectile 2 after a maximum tensile load in the range of 1,050 to 7000 lbf resulting in a net forward load acting on projectile 2.

Figure 4:
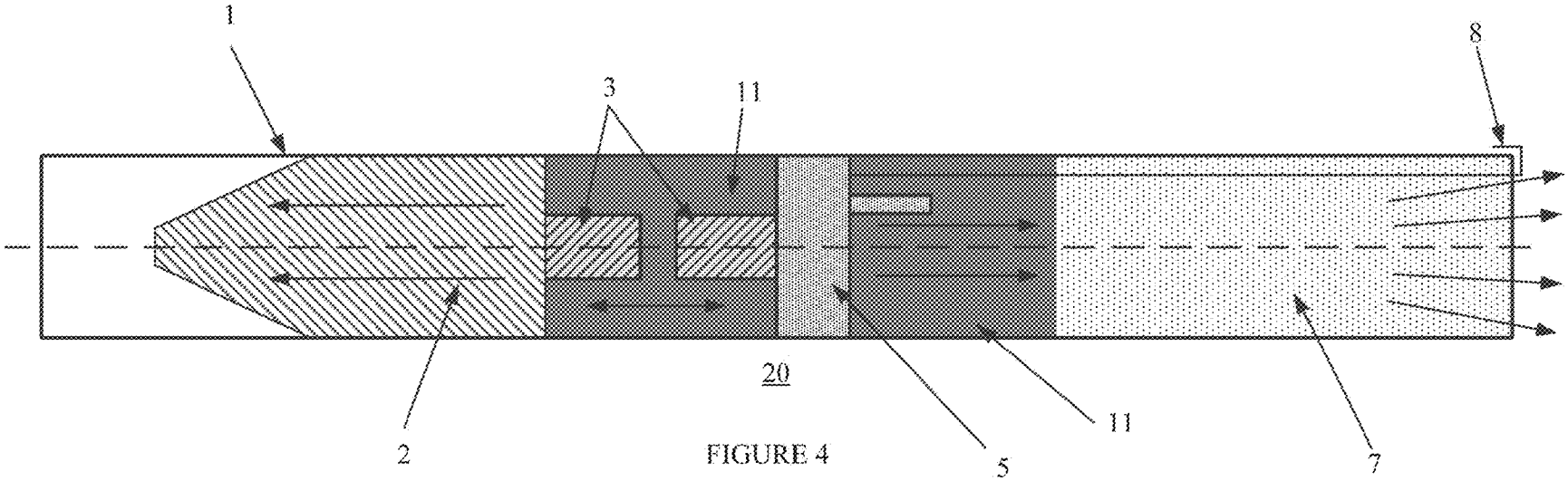
FIG. 4 illustrates a shoulder launched munition propulsion system during a third stage of operation.

As propellant gas 11 continues to expand, the pressure inside pressure vessel 1 continues to increase until the pressure reaches a second predetermined value. At this second predetermined value, rupture disk 5 opens and protrudes into countermass liquid 7, as shown in FIG. 4. The opening of rupture disk 5 allows propellant gas 11 to flow through rupture disk 5. As propellant gas 11 flows through rupture disk 5 towards countermass liquid 7, propellant gas 11 exerts a force against countermass liquid 7, which causes countermass liquid to flow towards the breach end of pressure vessel 1. The force exerted against countermass liquid 7 by propellant gas 11 causes countermass liquid 7 to dislodge aft seal 9 from pressure vessel 1 and exit pressure vessel 1 through the breach end of the pressure vessel.

Preferably, rupture disk 5 ruptures at a pre-determined static burst pressure in the range of 300 to 2,000 psi. More preferably, the static burst pressure of the rupture disk is in a range of 1,000 to 1,500 psi. Rupture disk 5 may be welded, for example, to pressure vessel 1.

In FIG. 4, propellant gas continues to expand and increase the pressure inside pressure vessel 1. The increasing pressure in pressure continues to exert a force against projectile 2 in the direction of the muzzle end of pressure vessel 1, and projectile 2 continues to move towards the muzzle end of pressure vessel 1.

Figure 2:
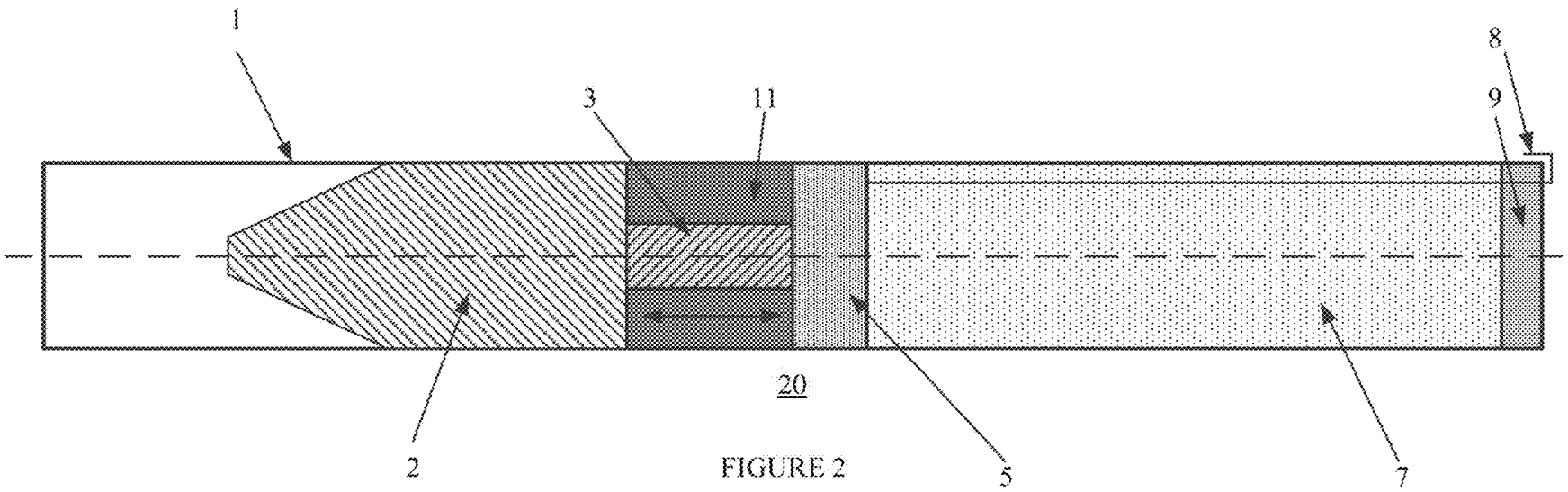
FIG. 2 illustrates a shoulder launched munition propulsion system during a first stage of operation.

As shown in FIG. 3, rupture disk 5 remains closed not exposing the propellant gases 11 to the countermass fluid 7. The relative timing of the release of projectile 2, as shown in FIG. 2, and the opening of the rupture disk 5, as shown in FIG. 4, ensures that minimal recoil is felt by the user. The timing of these events occurs across the operational temperature range of −60° F. to 160° F. for the propulsion system.

As shown in FIG. 4, the pressure in pressure vessel 1 has reached the static burst pressure of rupture disk 5, and rupture disk 5 has ruptured and is protruding into countermass 7 side of pressure vessel 1. Rupture disk 5 may rupture and open at a predefined static burst pressure in the range of 300 to 2,000 psi. The ruptured portion of rupture disk 5 remains connected to rupture disk 5 after rupturing.

Once rupture disk 5 has ruptured, the pressure continues to increase inside pressure vessel 1. This pressure may be defined as the peak pressure preferably is in the range of 8,000 to 9,000 psi. At this time within the internal ballistic event, countermass fluid 7 has ruptured aft seal 9 [no longer depicted in FIG. 4 since it has ruptured] and has begun to exit through the aft end of the system. After release of the projectile (i.e., projectile retention means 3 releases projectile 2), the primary load on the system is due to the viscous loads associated with expulsion of the countermass fluid in the breech direction. The temporal integral, with limits of integration set for the entirety of the firing event, of axial load is very close to zero, resulting in minimal recoil by the user.

Figure 5:
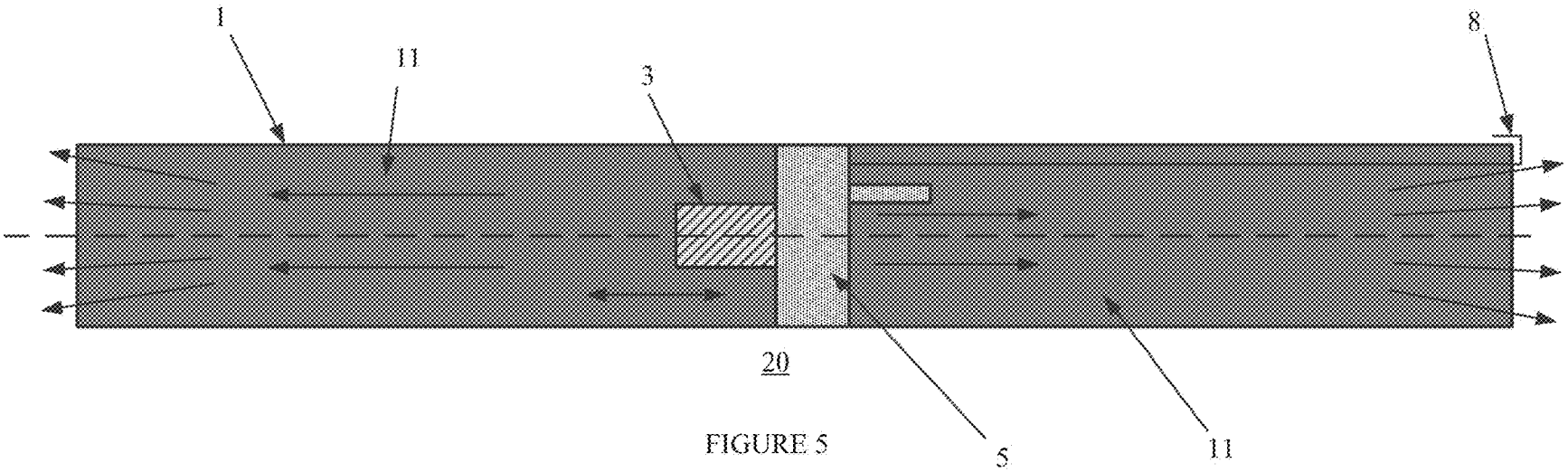
FIG. 5 illustrates a shoulder launched munition propulsion system during a fourth stage of operation.

FIG. 5 illustrates shoulder launched munition propulsion system 20 after projectile 2 has exited the muzzle end of pressure vessel 1 and after countermass liquid 7 has been completely ejected through the breach end of pressure vessel 1. When this occurs, propellant gas 11 exits through the muzzle and breach end of pressure vessel 1.

Preferably, the countermass 7 is a low-corrosion countermass fluid (LC-CMF). More preferably, the countermass 7 is a low-corrosion countermass fluid with a high density (i.e., density greater than 1 gm/cm$^3$) and a low freezing point (i.e., fluid does not freeze at −94° F. (−70° C.)). For example, the countermass can suitably be any of the countermass compositions described in the co-pending original U.S. patent application entitled "Countermass Liquid for a Shoulder Launched Munition Propulsion System" (filed the same day as the instant application), which claims priority from Provisional Application No. 62/301,269 of the same title, the disclosures of which are incorporated herein in their respective entireties. The countermass 7 is contained within the propulsion system on the breech end of the weapon with an elastomeric aft seal 9, which is capable of expanding and compensating for thermal contraction and expansion of the countermass 7 across the operational and storage temperature range of −60° F. to 160° F.

Preferably, the igniter charge 6 comprises an ignition charge of nitrates. More preferably, the igniter assembly 6 comprises an ignition charge of boron potassium nitrate ($BKNO_3$) pyrotechnic material, single base propellant, double base propellant, triple base propellant, or smokeless powder.

Preferably, the propellant charge 4 is double base propellant, single base propellant, or triple base propellant. More preferably, the propellant charge 4 is a nitrocellulose paper filled with an M9 propellant.

Preferably, rupture disk 5 composition of the countermass propulsion system is selected from the group consisting of at least one or more of a stainless steel and an austenite nickel-chromium-based superalloy.

In order to ensure that the countermass propulsion system functions properly, i.e., specifically, that the muzzle velocity requirements are met, it is important that the rupture disk 4 (also referred to as a burst disc) meet strict static burst pressures. In addition, the propulsion system has a single, petal-reversed dome rupture disk 20, which opens up when the peak pressure of 300 to 2,000 psi is reached within combustion chamber 7. The combination of these features ensures that the propellant charge 6 ignites properly, which results in the appropriate muzzle velocity at a given temperature while minimizing muzzle velocity variation at any given temperature.

An additional concern for a Fire From Enclosure (FFE) system is the hazard of exposure to the combustion products of the energetic material, primarily consisting of gases: $H_2O$, CO, $N_2$ and $CO_2$. When the weapon is fired, these gases are comingled with the LC-CMF, leading to the cooling of the gases without formation of additional toxic chemical species.

In contrast to the art that address corrosion by prepackaging their CMF, Nammo's countermass propulsion system does not require a separate container for the LC-CMF. The system is comprised of an outer and inner composite tube.

Pressure vessel 1 is the primary load-carrying structure within the system. The loads borne by the pressure vessel include those generated by combustion during the firing and are comprised of hoop pressure as well as bending and axial loads. The preferred embodiment of pressure vessel 1 has a constant inner diameter of 2.497 to 2.493 in. and contains a wound carbon fiber composite structure, which is fabricated using a resin transfer process. Alternate design approaches include a Ti-lined inner tube and a bare epoxy inner tube, resulting in a lightweight, rigid, and strong structure.

The pressure vessel 1 provides a cylindrical wall structure for the containment of countermass 7 and a structure for sealing the ends of countermass 7. On the aft end of the system aft seal 9 or aft cover keeps countermass 7 within the system. During firing, the aft seal 9 includes features to control the pressure at which the fluid is released and, during storage, to provide allowance for thermal expansion of countermass 7 across the wide storage temperature regime.

The detailed design of the rupture disk 5 is important in ensuring properly balanced system performance. System loads, muzzle velocity, and muzzle velocity variation are all factors affected by the burst design. In addition, the system level back-blast requirement specifies that the portion of rupture disk 5 that protrudes into countermass 7 remains attached to the pressure vessel after firing, i.e., no fragmentation allowed. The preferred embodiment provides consistent burst pressure opening, no fragments, minimum burst pressure variation and supports back pressure encountered during hydrostatic loads encountered due to 5 foot nose down drop testing. During the design phase, various rupture disk concepts have been evaluated. The rupture disk should open consistently without fragmentation while being backed by the high density LC-CMF and with a loading rate of millions of psi per second.

Projectile retention means 3 may be, for example, a breakbolt. As the pressure inside pressure vessel 1 increases, the axial force on the projectile retention means 3 elongates up to the point of material failure, and now-released projectile 2 is free to be propelled and accelerate down the pressure vessel 1 and down range to the target. The recoil of the system is balanced (near zero recoil energy) by properly specifying the rupture disk static burst pressure, the cross-sectional flow obstruction, and the breakbolt strength.

EXAMPLES

Testing

Extensive testing was performed to verify performance of the invention, totaling 184 test firings. The first series of testing was performed using varying configurations of propellant charges, combustion chamber size and retention feature release strengths. This test series fired 68 firings evaluating the pressure profile and gauging the system level for projectile velocity, peak pressure, and muzzle exit pressure at varying temperatures. A second test series was performed by firing 41 test firings with various component design parameters to evaluate the system for consistency and repeatable performance. A variety of data was obtained including: forward, aft and bending loads, pressure, velocity, and free field peak sound pressure. A third series was conducted with 35 test articles to evaluate the system's ability to survive the necessary environmental conditions, measure the sound performance when fired from a standard enclosure, and recoil performance. A fourth test series was performed with the final, inventive design consisting of 40 total test firings, where a sample of the rounds were exposed to the environmental test standard in the Joint Ordnance Test Procedure (JOTP)-010. JOTP-010 is a publically available test procedure that is readily understood by those of ordinary skill in the art, and it is incorporated herein in its entirety by way of this reference. Twenty-eight of these 40 firings were performed from inside an enclosure to measure the weapon system's Fire from Enclosure performance per MIL-STD-1474 (rev D and rev E) along with ballistic performance, and 12 of these firings were fired from a pendulum in the free field to measure recoil and free field sound performance per MIL-STD-1474 (rev D and rev E). All tests were performed at a variety of firing temperatures from −25 F to +140 F and after exposure to storage temperatures ranging from −60 F to +160 F. These tests performed provide a significant body of data substantiating the advantageous design results of the invention.

This extensive testing showed that the countermass propulsion system operated with near zero recoil energy at ambient and hot (i.e., 145° F.) temperature conditions. Recoil values at the cold temperature (i.e., −25° F.) produced the highest values with the average recoil of 1.67 ft.-lbs. This meets the mean recoil requirements of less than 16 ft.-lbs. The highest recoil value recorded at 1.68 ft.-lbf which meets the maximum recoil requirement of 45 ft.-lbs.

This extensive testing showed that the countermass propulsion system has a minimum of 8.4 firings per day with single hearing protection. The minimum of 8.4 firings per day with single hearing protection occurs at the operational hot condition of 145° F.

This extensive testing showed that the countermass propulsion system has an average maximum SPL of 172.7 dB at 145° F.

Finally, this extensive testing showed that the reduction in back blast is such that no hazardous debris is capable of perforating with non-zero residual velocity the second sheet of ½ in gypsum board installed in a wall located approximately 10 ft. behind the breach of the weapon. The two sheets of gypsum board were installed via standard construction methods using wooden 2×4 studs arranged in a 24 in on center configuration and installed into the enclosure from which the countermass propulsion system was being fire

The invention claimed is:

1. A countermass propulsion system for an FFE recoilless weapon, said system comprising:

a pressure vessel having a muzzle end and a breach end, wherein the vessel contains a projectile disposed at the muzzle end and a countermass disposed at the breach end;

a propellant charge, disposed between the projectile and the countermass;

a rupture disk disposed behind an igniter assembly and at a forward end of the countermass;

and a projectile retention means that is connected to the projectile and the rupture disk.

2. The countermass propulsion system of claim 1, said system having a minimized acoustic signature that is a sound pressure level (SPL) less than 175 dB as measured at a location 20 inches forward from the breach of the countermass propulsion system and 7 inches off of centerline of the weapon in the average of two locations, while being fired from a 15 foot ×12 foot ×7 foot enclosure.

3. The countermass propulsion system of claim 2, wherein the acoustic signature is an SPL of no more than 173.5 dB.

4. The countermass propulsion system of claim 2, wherein the acoustic signature is an SPL of no more than 170 dB.

5. The countermass propulsion system of claim 2, said system having a minimized recoil energy in the range of 0-16 ft·lbs.

6. The countermass propulsion system of claim 5, said system having a minimized recoil energy in the range of 0-5 ft·lbs.

7. The countermass propulsion system of claim 6, said system having a minimized recoil energy in the range of 0-2 ft·lbs.

8. The countermass propulsion system of claim 2, said system having a minimized recoil energy in the range of 0-2 ft·lbs., wherein the composition of the rupture disk is selected from the group consisting of at least one or more of a stainless steel and an austenite nickel-chromium-based superalloy.

9. The countermass propulsion system of claim 1, wherein said projectile retention means comprises one or more of a tensile rod and threads, tensile links, pins, threads, or combinations thereof.

10. The countermass propulsion system of claim 1, wherein said projectile retention means comprises a breakbolt.

11. The countermass propulsion system of claim 5, wherein said projectile retention means comprises a breakbolt and the breakbolt is configured to release the projectile after a maximum tensile load of 1,050 to 7,000 lbf is reached.

12. The countermass propulsion system of claim 1, further comprising an aft seal disposed behind the countermass at the breach end of the vessel.

13. The countermass propulsion system of claim 1, wherein said rupture disk is configured to remain closed during operation of the system to a predetermined point in time, thereby preventing the countermass from being exposed to combustion gases in the pressure vessel.

14. The countermass propulsion system of claim 11, wherein the rupture disk is configured to rupture and open at a static pressure in a range of 300 to 2,000 psi.

15. The countermass propulsion system of claim 14, wherein the rupture disk is configured to rupture and open at a static pressure in a range of 1,000 to 1,500 psi.

* * * * *